US010690408B2

(12) United States Patent
Lochner

(10) Patent No.: US 10,690,408 B2
(45) Date of Patent: Jun. 23, 2020

(54) METHOD AND DEVICE FOR VARIABLY OBTAINING ARGON BY MEANS OF LOW-TEMPERATURE SEPARATION

(71) Applicant: LINDE AKTIENGESELLSCHAFT, Munich (DE)

(72) Inventor: Stefan Lochner, Grafing (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 356 days.

(21) Appl. No.: 15/513,180

(22) PCT Filed: Sep. 23, 2015

(86) PCT No.: PCT/EP2015/001886
§ 371 (c)(1),
(2) Date: Mar. 22, 2017

(87) PCT Pub. No.: WO2016/058666
PCT Pub. Date: Apr. 21, 2016

(65) Prior Publication Data

US 2017/0299262 A1 Oct. 19, 2017

(30) Foreign Application Priority Data

Oct. 16, 2014 (EP) ..... 14003544

(51) Int. Cl.
*F25J 3/04* (2006.01)

(52) U.S. Cl.
CPC ..... *F25J 3/04678* (2013.01); *F25J 3/0409* (2013.01); *F25J 3/04412* (2013.01); (Continued)

(58) Field of Classification Search
CPC .... F25J 2245/50; F25J 2245/58; F25J 3/0409; F25J 3/04412; F25J 3/04678; F25J 3/04703; F25J 3/04727; F25J 3/04812
See application file for complete search history.

(56) References Cited

U.S. PATENT DOCUMENTS 6,269,659 B1 8/2001 De Bussy et al.
2012/0125045 A1* 5/2012 Howard ..... F25J 3/0409 62/644

FOREIGN PATENT DOCUMENTS

EP 1482266 A1 * 12/2004 ..... F25J 3/04084
EP 1482266 A1 12/2004
(Continued)

OTHER PUBLICATIONS

PDF Eng machine translation of EP 1482266 accessed Mar. 16, 2019 (Year: 2019).*

*Primary Examiner* — Cabrena Holecek
(74) *Attorney, Agent, or Firm* — Millen White Zelano & Branigan, PC; Brion P. Heaney

(57) ABSTRACT

A method and device to variably obtain argon by means of low-temperature separation. Feed air is cooled in a main heat exchanger and then conducted into a distillation column system with a high-pressure column and a low-pressure column. Argon is obtained using a crud argon column and a purified argon column. A purified liquid argon product flow is generated from an argon-enriched flow from the low-pressure column. In a first operating mode, a first quantity of purified argon product is discharged, and in a second operating mode, a reduced quantity of purified argon product is discharged. In the second operating mode, a gaseous argon return flow is drawn from the crude argon column or the purified argon column and heated in a separate passage of the main heat exchanger.

19 Claims, 1 Drawing Sheet

(52) U.S. Cl.
CPC ..... *F25J 3/04703* (2013.01); *F25J 3/04727* (2013.01); *F25J 3/04812* (2013.01); *F25J 2245/50* (2013.01); *F25J 2245/58* (2013.01)

(56) References Cited

FOREIGN PATENT DOCUMENTS

| | | | |
|---|---|---|---|
| FR | 2943773 | A1 | 10/2010 |
| JP | S5449978 | A | 4/1979 |
| JP | H1082582 | A | 3/1998 |

* cited by examiner

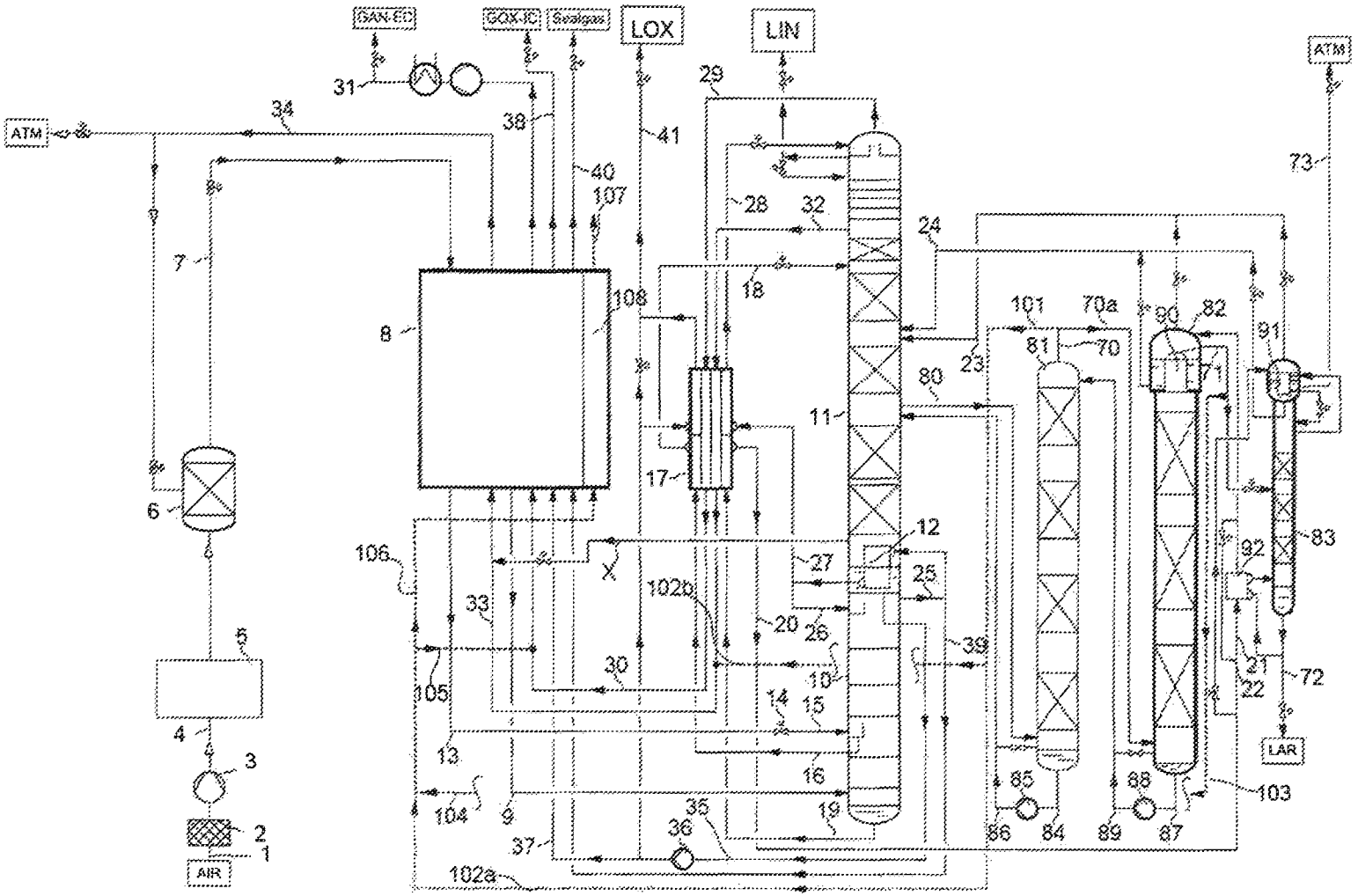
ATM
LAR
LIN
LOX
AIR
ATM

METHOD AND DEVICE FOR VARIABLY OBTAINING ARGON BY MEANS OF LOW-TEMPERATURE SEPARATION

The invention relates to a method of obtaining argon.

This way of obtaining argon is described, for example, in EP 2600090 A1. After a two-column or multi-column method for nitrogen/oxygen separation, in a crude argon column (of a two-part design here), argon and oxygen are separated and, in a further step, the pure argon column, argon and nitrogen. The crude argon from the crude argon column is introduced into the pure argon column in gaseous form.

"Argon-enriched" refers here to a stream having a higher argon concentration than air.

The crude argon column may have a one-part or multi-part design. It has a top condenser which is cooled with a liquid from the air fractionation method in the narrower sense, especially with bottoms liquid from the high-pressure column.

Typically, the entire liquid pure argon product stream is drawn off from the bottom of the pure argon column as the end product. The end product is, for example, obtained directly as the liquid product and introduced into a liquid tank. Alternatively, it is withdrawn in liquid form from the pure argon column or from the tank, compressed in liquid form and warmed in the main heat exchanger and fed directly as compressed gas product to a consumer. In many cases, the argon is sold as a liquid product.

Sales volumes for liquid argon vary depending on the market. In the case of some direct consumers of argon, the argon demand likewise varies in a cyclical or irregular manner, while the demand for oxygen and/or nitrogen (main product demand) remains the same. Typically, in such cases, the crude and pure argon column are correspondingly run up and down, i.e. operated with varying throughput.

It is an object of the invention, in a method specified at the outset, to increase the efficiency of the obtaining of oxygen with an argon demand varying relative to the main product demand. "Efficiency" of oxygen separation is understood here to mean the oxygen yield, especially the energy expenditure per $m^3$ (STP) of oxygen produced, with constant purity of the oxygen product.

This object is achieved by the invention as described herein. More particularly, in a second mode of operation, with reduced argon demand, at least one gaseous argon return stream is drawn off from the crude argon column, the top condenser thereof, the pure argon column or the top condenser, in order to reduce or entirely shut down pure argon production. The gaseous argon return stream is warmed without mixing with another stream in a separate passage of the main heat exchanger.

In the context of the invention, it has been found that the efficiency of the oxygen production depends on the quality of the argon removal. Therefore, even when the argon product is not required in full, if at all, the invention attempts to keep the argon yield as high as possible. If—as in the prior art—the conversion of the argon columns is run down, only the liquefaction energy for the argon which is not required is gained, but, on the other hand, the oxygen separation loses efficiency.

The gaseous argon return stream has an argon content at least twice as high as that of the argon-enriched stream from the low-pressure column (measured in molar amounts). The refrigeration energy present therein is recovered in the main heat exchanger, specifically by at least one of the following measures:

In one variant of the invention, a portion of the gaseous argon return stream is introduced into a return stream from the low-pressure column.

The gaseous argon return stream is warmed without mixing with another stream in a separate passage of the main heat exchanger.

In the context of the invention, the crude argon column or a portion thereof can be run with variable argon production at constant throughput, or at the nominal or maximum throughput for which the process is designed. The oxygen yield and the oxygen purity thus remain constantly high.

In general, in the first mode of operation, the entire volume of pure argon product is removed as the end product. The "second mode of operation" may then be constituted by any type of operation in which the end product volume is smaller than in the first mode of operation. The excess portion of the volume of pure argon product is then drawn off as the gaseous argon return stream even upstream of the pure argon column or from the pure argon column before it arrives at the bottom of the pure argon column. In the extreme case, no argon end product at all is produced and the pure argon column merely releases tail gas at the top.

In specific cases, however, even in the "first mode of operation", a first volume of argon return stream may already be conducted to the main heat exchanger, in this case, in the "second mode of operation", the amount of argon return stream to the main heat exchanger is greater than in the "first mode of operation".

U.S. Pat. No. 6,269,659 B 1 has already proposed, in the event of reduced argon demand, evaporating at least a portion of the crude argon fraction from the top of the crude argon column, mixing it with a tail gas stream from one of the columns of the air fractionator in the narrower sense and warming it in the main heat exchanger of the air fractionator.

However, this solution cannot be applied to processes in which the crude argon fraction is drawn off from the crude argon column in gaseous form and introduced into the pure argon column in gaseous form.

In principle, the portion of the gaseous argon return stream can be mixed with any return stream from the low-pressure column, provided that this is possible in terms of pressure level. Preference is given, however, to choosing one of the following return streams:

gaseous nitrogen product stream from the top of the low-pressure column, impure nitrogen stream from an intermediate point in the low-pressure column.

In this way, the pure products from the low-pressure column are not contaminated and the argon product can be viably utilized for regeneration of adsorbers or in a vaporization cooler.

Preferably, during the transition from the first to the second mode of operation, the absolute total volume of argon which is withdrawn from the crude argon column and pure argon column is kept essentially constant.

"Essentially constant" is understood here to mean a deviation of less than 5 mol %, especially of less than 2.5%.

In the first mode of operation, this total volume of argon is composed of the volume of argon product and the volume of argon present in the tail gas from the top of the pure argon column. If, for example, no argon product at all is obtained in the second mode of operation, the argon present in the argon return stream(s) and the argon volume present in the tail gas from the top of the pure argon column add up to the total volume of argon.

There follows a discussion of various options for drawing of the argon return stream. In the context of the invention, there are especially the following sources for the argon return stream:

- The gaseous argon return stream is formed by at least a portion of the crude argon fraction.
- The gaseous argon return stream is drawn off from an intermediate point in the crude argon column, i.e. with a higher argon content than the crude argon fraction.

In the case of a divided crude argon column, the gaseous argon return stream may also be drawn off:

- from an intermediate point in the first section of the crude argon column and/or
- the gaseous argon return stream from the top of the first section of the crude argon column.

In a further variant,

- a gaseous stream is drawn off from the pure argon column at any point, for example from the top (optionally from the top condenser of the pure argon column), directly via the bottom or at any intermediate point between the bottom and top.

BRIEF DESCRIPTION OF THE DRAWING

FIG. 1 illustrates an embodiment according to the invention.

The invention and further details of the invention elucidated in detail hereinafter with reference to a working example shown in schematic form in the drawing. In this drawing, the warm part of the plant is particularly depicted schematically; machines such as turbines and recompressors have also been omitted.

Atmospheric air is sucked in through a filter 2 from an air compressor 3. The compressed air 4 from the air compressor 3 is cooled in a preliminary cooling unit 5 and cleaned in a cleaning apparatus 6. The cleaned air 7 is fed to a main heat exchanger 8. A first cold air stream 9 is introduced in essentially gaseous form into the high-pressure column 10. The high-pressure column 10 is part of a double column which also includes a low-pressure column 11 and a main condenser 12. These apparatuses are part of a distillation column system.

A second cold air stream 13 which has optionally been branched off from stream 7 and compressed to a high pressure is expanded in a valve 14 and introduced (15) mainly in liquid form into the high-pressure column 10. A portion 16 of this liquid is drawn off again straight away, cooled in a subcooling countercurrent heat exchanger 17 and introduced via conduit 18 into the low-pressure column 11. An oxygen-enriched fraction 19 from the bottom of the high-pressure column 10 is cooled in the subcooling countercurrent heat exchanger 17. A first portion 21 of the cooled oxygen-enriched fraction 20 is guided through the reboiler 91 of the pure argon column 83 and further into the evaporation space of the crude argon column top condenser 90. A second portion 22 flows directly into the evaporation space of the pure argon column top condenser 91. The components that have remained in liquid form and the gaseous components from the top condensers are combined in pairs and fed into the low-pressure column 11 via the conduits 23 and 24. Alternatively, these streams can each be conducted separately into the low-pressure column.

A portion of the tops nitrogen 25 from the high-pressure column 10 is condensed in the main condenser 12 and a first portion 26 is introduced to the high-pressure column. A second portion 27 of the liquid nitrogen flows through the subcooling countercurrent heat exchanger 17 and through conduit 28 to the top of the low-pressure column.

As products, the following streams leave the double column:

- liquid nitrogen (LIN) from the top of the low-pressure column
- gaseous externally compressed nitrogen (GAN-EC) via conduits 28, 29, 30
- gaseous impure nitrogen via conduits 32, 34
- internally compressed oxygen (GOX-IC) via conduits 35, 37, 38 and pump 36 (it would alternatively be possible to use a secondary condenser)
- liquid oxygen (LOX) via conduit 41
- compressed nitrogen as seal gas via conduits 39, 40

In addition, via the conduit X, gaseous oxygen can be fed from the bottom of the low-pressure column 11 into the tail gas conduit 33.

There now follows a description of the obtaining of argon. An argon-enriched stream 80 from the low-pressure column 11 is introduced into a crude argon column which, in the example, takes the form of a divided crude argon column having two sections 81, 82. In normal operation ("first mode of operation"), the tops vapor 70 from the first section 81 is introduced completely via conduit 70*a* into the second section 82. In the top condenser 90, reflux liquid is produced. The liquid 87 arriving in the bottom of the second section 82 is applied by means of a pump 88 via conduit 89 to the top of the first section 81. The liquid 84 that accumulates in the bottom of the first section 81 is likewise pumped and returned to the low-pressure column 11 via conduit 6.

From the top of the second section 82 of the crude argon column, more specifically from the liquefaction space of the top condenser 90, a gaseous crude argon fraction 71 is withdrawn and introduced in full in gaseous form into the pure argon column 83. From the bottom of the pure argon column 83, a liquid pure argon product stream 72 is withdrawn. From the top condenser 91 of the pure argon column, a tail gas stream 73 is drawn off and discharged into the atmosphere (ATM).

For the second mode of operation, the drawing shows various variants of the leading-off of an argon return stream according to the invention. In principle, it is also possible in a real plant to implement two or more of the variants simultaneously. In general, however, a single variant will be chosen.

In one variant, the gaseous argon return stream or a portion thereof is formed by a portion of the tops vapor 70 of the first section 81 of the crude argon column. It is guided with the aid of conduits 101, 102*a*, 105, 106, 107 through the separate passage 108 of the main heat exchanger. A portion 102*b* can be introduced into the impure nitrogen 32 downstream of the subcooling countercurrent heat exchanger 17; alternatively, the introduction can be conducted upstream of the subcooling countercurrent heat exchanger 17.

In a further variant of the invention, the gaseous argon return stream is formed by a portion of the crude argon fraction 71 or by the entire crude argon fraction 71 and guided via conduits 103, 104, 106 into the separate passage 108 of the main heat exchanger. In a different option, a portion can be introduced into the gaseous nitrogen product stream 30 downstream of the subcooling countercurrent heat exchanger 17 (conduits 103, 104, 105); alternatively, the introduction can be conducted upstream of the subcooling countercurrent heat exchanger 17.

If the argon return stream, in the second mode of operation, is not mixed with another stream, it is conducted through a separate passage 108 of the main heat exchanger 8. "Passage" is understood here to mean a multitude of passes through the main heat exchanger 8 through which the same stream flows.

Of course, it is possible in the context of the invention for the different withdrawals 101, 103 of the argon return stream each to be combined with any mode of conduction through the main heat exchanger 8.

In a second mode of operation with reduced demand for argon product, the conduit 101 is opened, and 0% to 3.5% of the tops vapor 70 or of the ascending vapor in the crude argon column 81, 82 is conducted into the main heat exchanger 8. In a specific numerical example, only 70% of the maximum possible volume of argon is required as product by the operator. The "second volume of pure argon product" is thus 70% of the maximum argon product. The argon return stream 101 then comprises, for example, 1% of the tops vapor 70. The rest of the tops vapor 70 from the crude argon column is still introduced via conduit 70*a* into the second section 82 of the crude argon column.

The invention claimed is:

1. A method of variably obtaining argon by cryogenic fractionation, comprising:

cooling feed air in a main heat exchanger, introducing cooled feed air into a distillation column system having a high-pressure column and a low-pressure column, introducing an argon-enriched stream from the low-pressure column into a crude argon column, said crude argon column having a top condenser, withdrawing a crude argon fraction in gaseous form from the top of the crude argon column or from the top condenser thereof, introducing the crude argon fraction in gaseous form into a pure argon column, said pure argon column having a top condenser, withdrawing a liquid pure argon product stream from the bottom of the pure argon column, wherein in a first mode of operation, a first volume of pure argon product is removed as end product, in a second mode of operation, a second volume of pure argon product is removed as a volume of end product smaller than the first volume of pure argon product, in the second mode of operation a first volume of a gaseous argon return stream is withdrawn at one or more of the following points:

the crude argon column, the top condenser of the crude argon column, the pure argon column, the top condenser of the pure argon column, and in the first mode of operation no gaseous argon return stream or a lower volume than said first volume of gaseous argon return stream is withdrawn from the crude argon column, the top condenser of the crude argon column, the pure argon column, and/or the top condenser of the pure argon column, wherein the argon content of the gaseous argon return stream is at least twice as high as that of the argon-enriched stream from the low-pressure column, the gaseous argon return stream is warmed in the main heat exchanger, and at least a portion of the gaseous argon return stream is warmed without mixing with another stream in a separate passage of the main heat exchanger.

2. The method as claimed in claim 1, wherein a portion of the gaseous argon return stream is introduced into a return stream from the low-pressure column upstream of the main heat exchanger and warmed together therewith in the main heat exchanger.

3. The method as claimed in claim 1, wherein, in the second mode of operation, a portion of the gaseous argon return stream is introduced into at least one of the following return streams from the low-pressure column:

into a gaseous nitrogen product stream from the top of the low-pressure column, into an impure nitrogen stream from an intermediate point in the low-pressure column.

4. The method as claimed in claim 1, wherein, during transition from the first to the second mode of operation, the absolute total volume of argon withdrawn from the crude argon column and pure argon column is kept essentially constant.

5. The method as claimed in claim 1, wherein the gaseous argon return stream is formed by at least a portion of the crude argon fraction.

6. The method as claimed in claim 1, wherein the gaseous argon return stream has a higher oxygen content than the crude argon fraction.

7. The method as claimed in claim 6, wherein the crude argon column has a first section and a second section having separate vessels, the argon-enriched stream from the low-pressure column is introduced into the first section, and the gaseous argon return stream is drawn off from the first section of the crude argon column.

8. The method as claimed in claim 1, wherein the gaseous argon return stream is withdrawn from the pure argon column or the top condenser thereof.

9. The method as claimed in claim 1, wherein, in the second mode of operation, the gaseous argon return stream is drawn off from the crude argon column.

10. The method as claimed in claim 1, wherein, in the second mode of operation, the gaseous argon return stream is drawn off from the top condenser of the crude argon column.

11. The method as claimed in claim 1, wherein, in the second mode of operation, the gaseous argon return stream is drawn off from the pure argon column.

12. The method as claimed in claim 1, wherein, in the second mode of operation, the gaseous argon return stream is drawn off from the top condenser of the pure argon column.

13. The method as claimed in claim 1, wherein, in the second mode of operation, a portion of the gaseous argon return stream is introduced into a gaseous nitrogen product stream from the top of the low-pressure column.

14. The method as claimed in claim 1, wherein, in the second mode of operation, a portion of the gaseous argon return stream is introduced into an impure nitrogen stream from an intermediate point in the low-pressure column.

15. The method as claimed in claim 6, wherein the crude argon column has a first section and a second section having separate vessels, the argon-enriched stream from the low-pressure column is introduced into the first section, and the gaseous argon return stream is drawn off from the top of the first section of the crude argon column.

16. The method as claimed in claim 1, wherein the crude argon column has a first section and a second section having separate vessels, the argon-enriched stream from the low-pressure column is introduced into the first section, and the gaseous argon return stream is drawn off from the first section of the crude argon column.

17. The method as claimed in claim 1, wherein the gaseous argon return stream is withdrawn from an intermediate point of the crude argon column.

18. The method as claimed in claim 1, wherein the crude argon column has a first section and a second section having separate vessels, and vapor withdrawn from the top of the first section is introduced into the bottom of the second section wherein in the first mode of operation, all of the vapor withdrawn from the top of the first section is introduced into the bottom of the second section, and in the second mode of operation a portion of the vapor withdrawn from the top of the first section is said gaseous argon return stream.

19. A method of variably obtaining argon by cryogenic fractionation, comprising:

compressing feed air in a main compressor to form compressed feed air, cooling all of the compressed feed air in a main heat exchanger to form cooled and compressed feed air, introducing all of the cooled and compressed feed air into a dual distillation column system consisting of a high-pressure column and a low-pressure column, introducing an argon-enriched stream from the low-pressure column into a crude argon column, said crude argon column having a top condenser, withdrawing a crude argon fraction in gaseous form from the top of the crude argon column or from the top condenser thereof, introducing the crude argon fraction in gaseous form into a pure argon column, said pure argon column having a top condenser, withdrawing a liquid pure argon product stream from the bottom of the pure argon column, wherein in a first mode of operation, a first volume of pure argon product is removed as end product, and in a second mode of operation, a second volume of pure argon product is removed as a volume of end product smaller than the first volume of pure argon product, and in the second mode of operation a gaseous argon return stream is withdrawn at one or more of the following points:

the crude argon column, the top condenser of the crude argon column, the pure argon column, the top condenser of the pure argon column, wherein the argon content of the gaseous argon return stream is at least twice as high as that of the argon-enriched stream from the low-pressure column, the gaseous argon return stream is warmed in the main heat exchanger and at least a portion of the gaseous argon return stream is warmed without mixing with another stream in a separate passage of the main heat exchanger.

* * * * *